United States Patent [19]

Pokhis

[11] 4,237,634

[45] Dec. 9, 1980

[54] ARTICLE OF ADVERTISEMENT

[76] Inventor: Naum Pokhis, 30-36 Magaw Pl., Apt. 5D, New York, N.Y. 10033

[21] Appl. No.: 51,342

[22] Filed: Jun. 25, 1979

[51] Int. Cl.[3] ..... G09F 19/08

[52] U.S. Cl. ..... 40/422; 40/425; 46/167

[58] Field of Search ..... 40/425, 422, 416, 412, 40/406; 46/165, 167, 1681169 R, 169 A, 169 B

[56] References Cited

U.S. PATENT DOCUMENTS

| | | | |
|---|---|---|---|
| 1,118,370 | 11/1914 | Russell | 40/425 |
| 1,138,737 | 5/1915 | Dunham | 40/425 |
| 1,194,853 | 8/1916 | McCormack | 40/425 |
| 1,379,861 | 5/1921 | Goldmann | 40/425 |
| 1,455,179 | 5/1923 | Ward | 40/425 X |
| 2,746,204 | 5/1956 | Karpf | 46/165 X |

*Primary Examiner*—John F. Pitrelli
*Attorney, Agent, or Firm*—Ilya Zborovsky

[57] ABSTRACT

An article of advertisement includes a transparent container, and a plate-like member located in the container and carrying an image of eyes. When the article is mounted on a movable object such as a vehicle, the plate-like member displaces relative to the container since one of the transverse dimensions of the plate-like member is smaller than a respective one of the dimensions of the inner chamber of the container. This provides for impression of moving eyes. The inner chamber of the container may be filled by a transparent liquid so that the plate-like member floats in the inner chamber. Thereby, friction between the walls of the container and the member is eliminated, and the eyes in the liquid have a greater impression of movability and sparkling.

7 Claims, 10 Drawing Figures

ARTICLE OF ADVERTISEMENT

BACKGROUND OF THE INVENTION the present invention relates to an article of advertisement. More particularly, it relates to an article of advertisement, which imitates eyes and an advertisement object including such an article.

In articles of advertisement, especially the articles such as pictures mounted on movable objects and having images of eyes, the latter are the most important part which attracts attention of viewers. The term "movable objects" here includes vehicles, movable stands, card and the like which can be moved. However, eyes provided on the movable objects are immovable relative to the latter. The immovability of the eyes naturally reduces effect of the advertisement.

SUMMARY OF THE INVENTION

Accordingly, it is an object of the present invention to provide an article of advertisement and an object including the same, which avoid the disadvantages of the prior art.

More particularly, it is an object of the present invention to provide an article of advertisement and an object including the same in which eyes depicted thereon are movable relative to the object.

In keeping with these objects and with others which will become apparent hereinafter, one feature of the present invention resides, briefly stated, in an article of advertisement which includes a container having an inner chamber, and a plate-like member in said inner chamber and having at least one dimension which is smaller that a respective one of the dimensions of the inner chamber. The member carries an image of at least an iris and a pupil. In such a construction when the object moves, the inner member carring the eyes image moves relative to the container and to the object mounting the latter so that the impression of moving eyes is provided.

When the article of advertisement is so constructed, the effect of the advertisement is essentially increased since the eyes "move" relative to the object.

The novel features which are considered as characteristic for the present invention are set forth in particular in the appended claims. The invention itself however both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
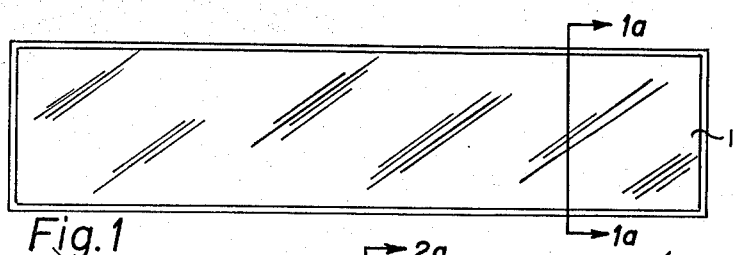
FIG. 1 is a front view showing a container of an article of advertisement in accordance with the present invention.
Figure 1A:
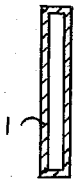
FIG. 1*a* is a side sectional view taken along lines 1*a*—1*a* in FIG. 1.
Figure 2:
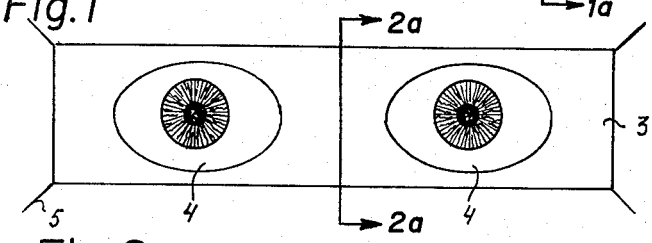
FIG. 2 is a front view showing a plate-like member accommodated in the container of FIG. 1.
Figure 2A:
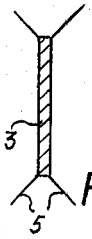
FIG. 2*a* is a side sectional view taken along line 2*a*—2*a* of FIG. 2.

An article of advertisement in accordance with the present invention includes a container which is shown in FIG. 1 and identified by reference numeral 1. It is shown schematically. The container 1 bounds an inner chamber which is substantially flat and has two transverse dimensions, that is the length and the width. A flat plate-like member or plate 3 is further provided and has also two transverse dimensions, that is the length and the width. The plate 3 is provided with images of an iris and pupil of eyes. It can also be provided with images of a white surrounding the respective image of iris.

The plate 3 is inserted into the inner chamber 2 of the container 1. The container 1 has at least one transparent wall at the side toward which the eyes of the plate 3 face. It is understood that the entire container 1 may have transparent walls. At least one of the dimensions of the plate 3 is smaller than a respective one of the dimensions of the inner chamber 2 of the container 1. The plate 3 may be narrower or shorter (or narrower and shorter) than the inner chamber 2 of the container 1. Thereby, the plate 3 can move in the interior of the inner chamber 2 of the container 1.

In accordance with the important inventive feature, the plate 3 is so arranged in the inner chamber 2 that it moves with only minimum friction relative to the walls of the container 1. For this purpose intermediate means is provided between the plate 3 and the walls of the container 1. As can be seen from FIG. 3*a*, rollers 7 may be provided between the plate 3 and the walls of the container 1 so that the former can roll over the latter. As shown in dotted lines in the same Figure, the plate 3 may be suspended from the wall of the container 1 by a spring 8, or the spring 8 may be merely braced between the former and the latter.

Figure 3:
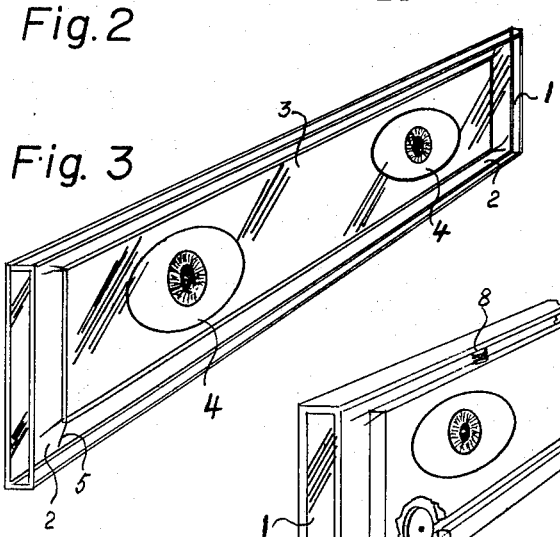
FIG. 3 is a perspective view of the article of advertisement in accordance with the present invention.
Figure 3A:
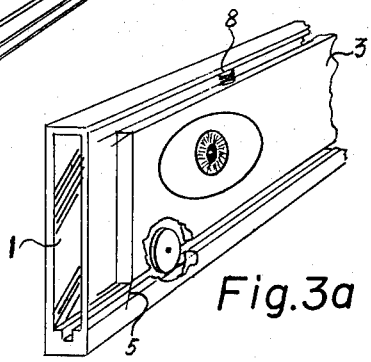
FIG. 3*a* is a perspective view corresponding to that shown in FIG. 3 but illustrating another embodiment of the present invention.
Figure 4:
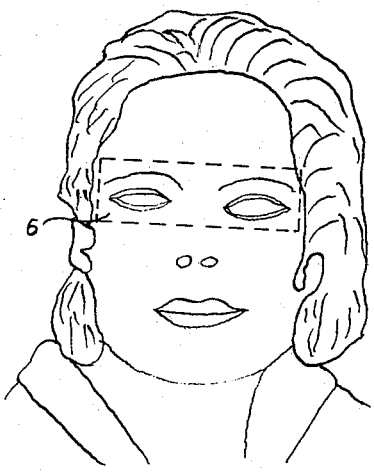
FIG. 4 is a view showing an object on which the article of advertisement is mounted.

An especially advantageous embodiment of the present invention is shown in FIG. 3. In accordance with this embodiment, the inner chamber 2 of the container 1 is filled by a liquid. The liquid is substantially transparent or may have some very slight color. The plate 3 floats in the liquid in suspended state together with the image of eyes 4 provided thereon. This impart to the eyes natural movability to a greater extent and also imparts constant sparkling. At the same time, this embodiment is characterised by especially simple construction.

In order to prevent direct contact, the plate 3 is provided with thin and resiliently yielding projections such as wires or the like. When the plate 3 moves inside the chamber 2 of the container 1, the projections 5 abut against the walls of the container 1 when the plate 3 tends to approach the walls of the container 1.

The inventive article of advertisement is utilized in the following manner. The container 1 is attached, such as glued for example, to an object, the object being an advertisement picture. The picture is provided with holes for eyes which are identified by reference numeral 6. It is understood that the container 1 is attached to the picture at the reverse side of the picture in the region of eyes holes 6, which is depicted by dotted lines. When such a picture is mounted on a movable object such as a vehicle, a movable stand, a card moved by a user, then during movement of the latter together with the picture the plate 3 moves inside the container 1 as a result of inertia forces relative to the container and to the eyes holes 6. This always takes place during movement since the movement always involves some changes of the speed of movement. Even small changes of the speed will result in the above-mentioned movement of the plate 3 with the eyes, 4.

Figure 5:
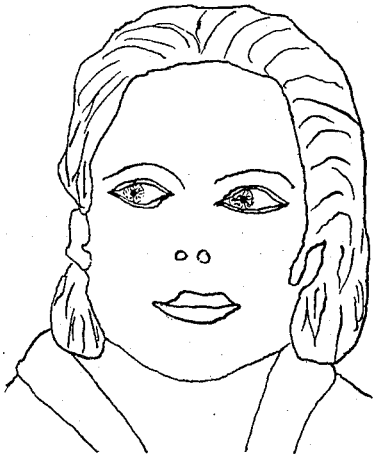
FIGS. 5–7 are view showing the object with the article of advertisement mounted thereon, with several positions of "eyes" provided in the inventive article.
Figure 6:
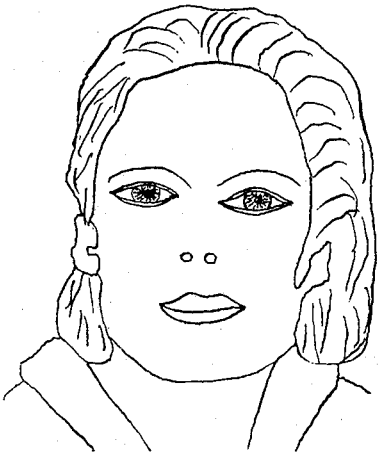
Figure 7:
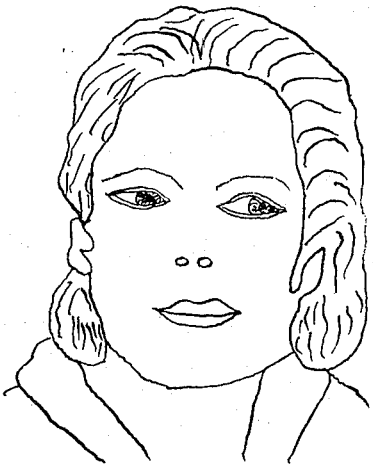

As shown in FIGS. 5–7, the eyes 4 move during the movement of the object. FIGS. 5 and 7 show the positions of the eyes during acceleration and deceleration of the objects. FIG. 6 shows an intermediate position, or position during very uniform movement of the object.

The container 1 and the plate 3 are flat in the above-mentioned Figures of the drawing. However they may be convex, concave and curved in any manner when the objects on which the inventive article of advertisement is to be mounted are voluminous and must have non-straight observe faces. In such constructions, the plate 3 and the eyes 4 may move along a curved path, such as along a part of a circle.

It will be understood that each of the elements described above, or two or more together, may also find a useful application in other types of constructions differing from the types described above.

While the invention has been illustrated and described as embodied in the above mentioned article, it is not intended to be limited to the details shown, since various modifications and structural changes may be made without departing in any way from the presentb invention.

Without further analysis, the foregoing will so fully reveal the gist of the present invention that others can, without applying current knowledge, readily adapt it for various applications without ommitting features which, from the standpoint of prior art fairly constitute essential characteristics of the generic or specific aspects of this invention.

What is claimed as new and desired to be protected by Letters Patent is set forth in the appended claims:

1. An article of advertisement imitating eyes and mountable on a movable object having a front surface, a rear surface, and eye holes, the article comprising a container having an inner chamber which has two transverse dimensions and having a transparent wall positionable behind the rear surface of the object in the region of eye holes;

a substantially flat member located in said inner chamber of said container and provided with an image of at least an iris and a pupil, said member having two dimensions which are also transverse and at least one of which is smaller than a respective one of the transverse dimensions of said inner chamber of said container so that when the object moves, said member displaces relative to said container so as to provide for impression of moving eyes; and means in said inner chamber for controlling the displacement of said member inside said container, said controlling means being a transparent liquid which fills said inner chamber of said container so that said member floats in said liquid.

2. An article as defined in claim 1, wherein the other dimension of said member is also smaller than the other dimension of said inner chamber of said container.

3. An article as defined in claim 1, wherein said member is further provided with an image of a white around said iris.

4. An article as defined in claim 1; and further comprising means for preventing direct contact of said member with the walls of said container, said preventing means including projections extending outwardly from said member so as to abut against the walls of said container when said member tends to approach said walls.

5. An article as defined in claim 4, wherein said projections are relatively thin and resiliently deformable.

6. An article as defined in claim 5, wherein said member has corner regions, said projections being arranged in said corner regions.

7. A movable object of advertisement, comprising a base portion which is movable and has a front surface, a rear surface, and eye holes;

a substantially flat container having an inner chamber which has two dimensions, and a transparent wall mountable behind said rear surface of said base portion in the region of said eye holes;

a substantially flat member located in said container and provided with an image of at least an iris and a pupil, said member having two transverse dimensions at least one of which is smaller than a respective one of the transverse dimensions of said inner chamber of said container so that when said base portion moves, said member displaces relative to said container and said eyes holes of said base portion so as to provide for impression of moving eyes; and means in said inner chamber for controlling the displacement of said member inside said container, said controlling means being a transparent liquid which fills said inner chamber of said container so that said member floats in said liquid.

* * * * *